US006553637B1

(12) United States Patent
Chen

(10) Patent No.: US 6,553,637 B1
(45) Date of Patent: Apr. 29, 2003

(54) MOVABLE BUCKLE STRUCTURE

(76) Inventor: Ang-Yu Chen, No. 7 Alley 1, Lane 516, Sec. 3, Tai-Ho Road, Chang-Hua (TW)

( * ) Notice: Subject to any disclaimer, the term of this patent is extended or adjusted under 35 U.S.C. 154(b) by 0 days.

(21) Appl. No.: 09/982,871

(22) Filed: Oct. 22, 2001

(51) Int. Cl.[7] ..... A44B 11/25
(52) U.S. Cl. ..... 24/614; 24/615; 24/625
(58) Field of Search ..... 24/614, 615, 625, 24/666, 580, 701; 450/36

(56) References Cited

U.S. PATENT DOCUMENTS 1,477,597 A * 12/1923 Schneider ..... 24/614
1,548,023 A * 8/1925 Cowell ..... 24/625
4,559,679 A * 12/1985 Downey ..... 24/615
5,144,725 A * 9/1992 Krauss ..... 24/625
5,355,562 A * 10/1994 Matoba et al. ..... 24/625
5,791,026 A * 8/1998 Anscher ..... 24/615
5,845,376 A * 12/1998 Tung ..... 24/625
6,052,875 A * 4/2000 Fudaki ..... 24/625

* cited by examiner

*Primary Examiner*—Victor Sakran
(74) *Attorney, Agent, or Firm*—Rabin & Berdo, P.C.

(57) ABSTRACT

An improved movable buckle structure, wherein its male connector and female connector are made of metal, is characterized in that two pivotal connecting bases and a guiding block are integrally coupled and disposed at the front lateral side of the male connector, and two concave grooves are disposed between the inner side of the two pivotal connecting bases and the outer side of the guiding block for embedding two elastic brackets, fixing in position, and providing elasticity. It makes two latching blocks to extend outward or contract inward such that the female connector can be locked or detached. Such structure can stand coldness and will not become brittle, and further can strengthen the exerted tension as well as the durability and artistic look, and thus enhancing the company's competitiveness and satisfying the consumer's needs.

3 Claims, 3 Drawing Sheets

MOVABLE BUCKLE STRUCTURE

BACKGROUND OF THE INVENTION

1. Field of the Invention

The present invention relates to an improved movable buckle structure, wherein its male connector and female connector are made of metal, characterized in that two pivotal connecting bases and a guiding block are integrally coupled and disposed at the lateral side of the front end of the male connector, and two concave grooves are disposed between the inner side of the two pivotal connecting bases and the outer side of the guiding block for embedding two elastic brackets, fixing in position, and providing elasticity. It makes two latching blocks to extend outward or contract inward such that the female connector can be locked or detached. Such structure can stand coldness and will not become brittle, and further can strengthen the exerted tension as well as the durability and artistic look, and thus enhancing the company's competitiveness and satisfying the consumer's needs.

2. Description of the Prior Art

Generally, a movable buckle is composed of a male connector and a female connector, and the traditional male connector and female connector are made of plastic material. Its shortcomings including its brittle property that will be damaged easily in cold zones, its limited exerted tension, and inharmonic appearance, etc generally cause the product to break or damage. It does not comply with the requirements for market competitiveness, environment protection, and consumer's needs.

In view of the shortcomings and inconvenience of the prior art mentioned above, which are the subjects of improvements for a long time, hence the inventor of the present invention based on years of experience accumulated from the engagement in the related industry conducted extensive research to resolve the foregoing shortcomings and invented the present invention.

Therefore, the primary objective of the present invention is to use the traditional movable buckle structure as a base to make changes to the material selection and manufacture technology on the male connector such that the design of the integrally coupled male connector, pivotal connecting base, and guiding block can couple to the components such as the latching block and the pivotal member, and it also meets the requirement of the principle of elasticity for the elastic bracket. When external force is exerted, the two latching blocks generate an extension or contraction to lock or detach the female connector. Therefore, it enhances the competitiveness of the product, satisfies customer's requirements, and complies with the quality standard specification of the product.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
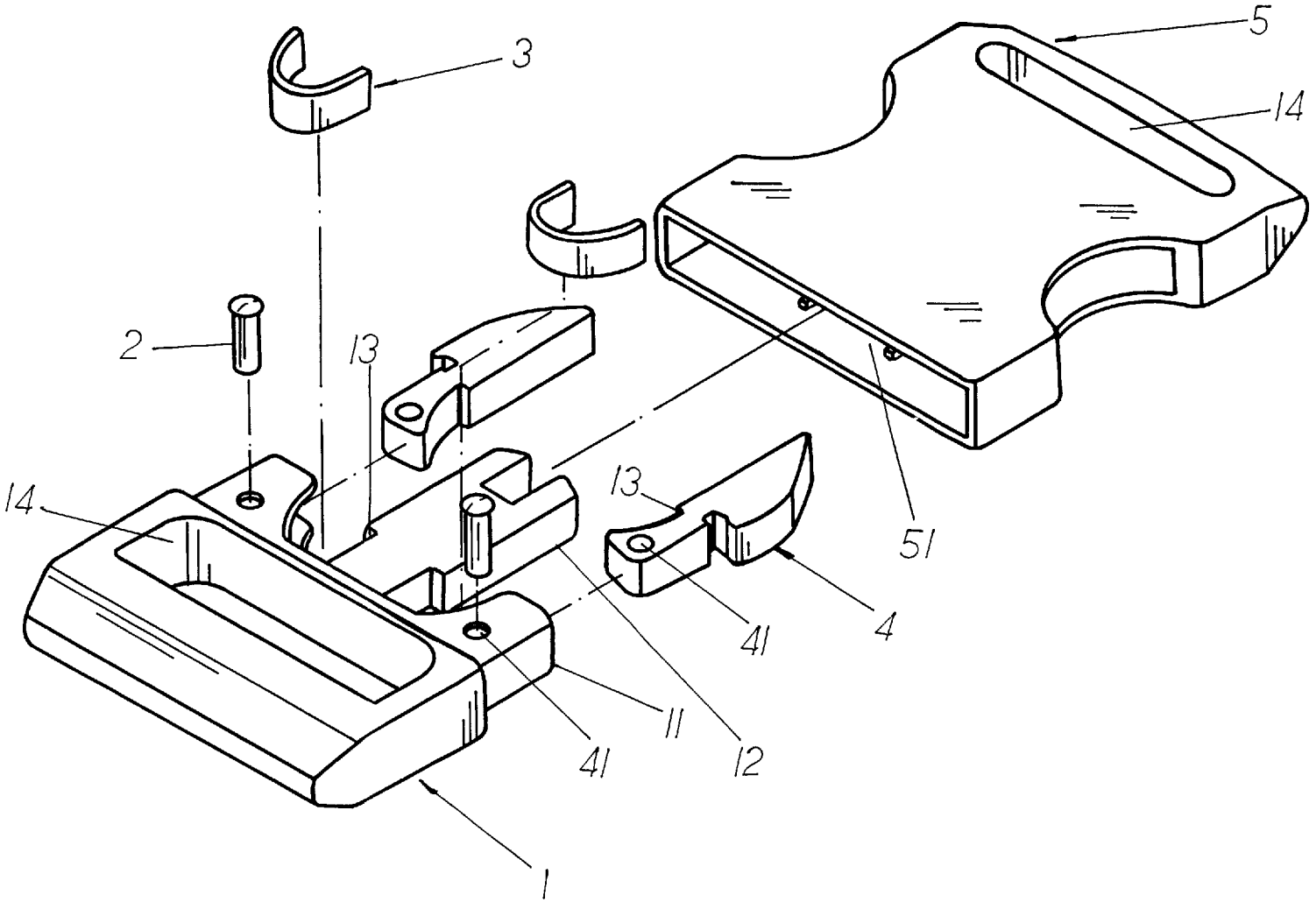
FIG. 1 shows the diagram of disassembled parts of the buckle structure of the present invention.

Please refer to FIG. 1, which shows an improved movable buckle structure, comprising a male connector 1 and a metal female connector 5, wherein the male connector 1 is made of metal with a design of integral formation. A belt hole 14 having a rectangular opening is disposed at the central position of the tip of the male connector 1 for coupling a belt 6 (see FIG. 3), and a pair of bases 11 are protruded from the sides in the front end of the belt hole 14, and a pivotal hole 41 is disposed on each of the bases for embedding two pivotal latching blocks 4. Two pivotally coupling members 2 are inserted into the respective pivotal holes 41 for the positioning, and two elastic brackets 3 are then placed into the interior of a U-shaped groove (or groove in another shape according to the assembling design of the latching block 4, guiding block 12, and base 11) between the latching block 4 and the guiding block 12, such that both ends of the two elastic brackets 3 can press against the pressing surface 13 at the inner side of the bottom of the latching block 4 and the pressing surface 13 at the outer side of the bottom of the guiding block 12. Due to the external force exerted on the two elastic brackets 3, the elasticity compels the two latching blocks 4 to contract or extend to detach or lock the female connector 5. A guiding track 51 is disposed in the interior of the female connectors for guiding the guiding block 12.

Figure 2:
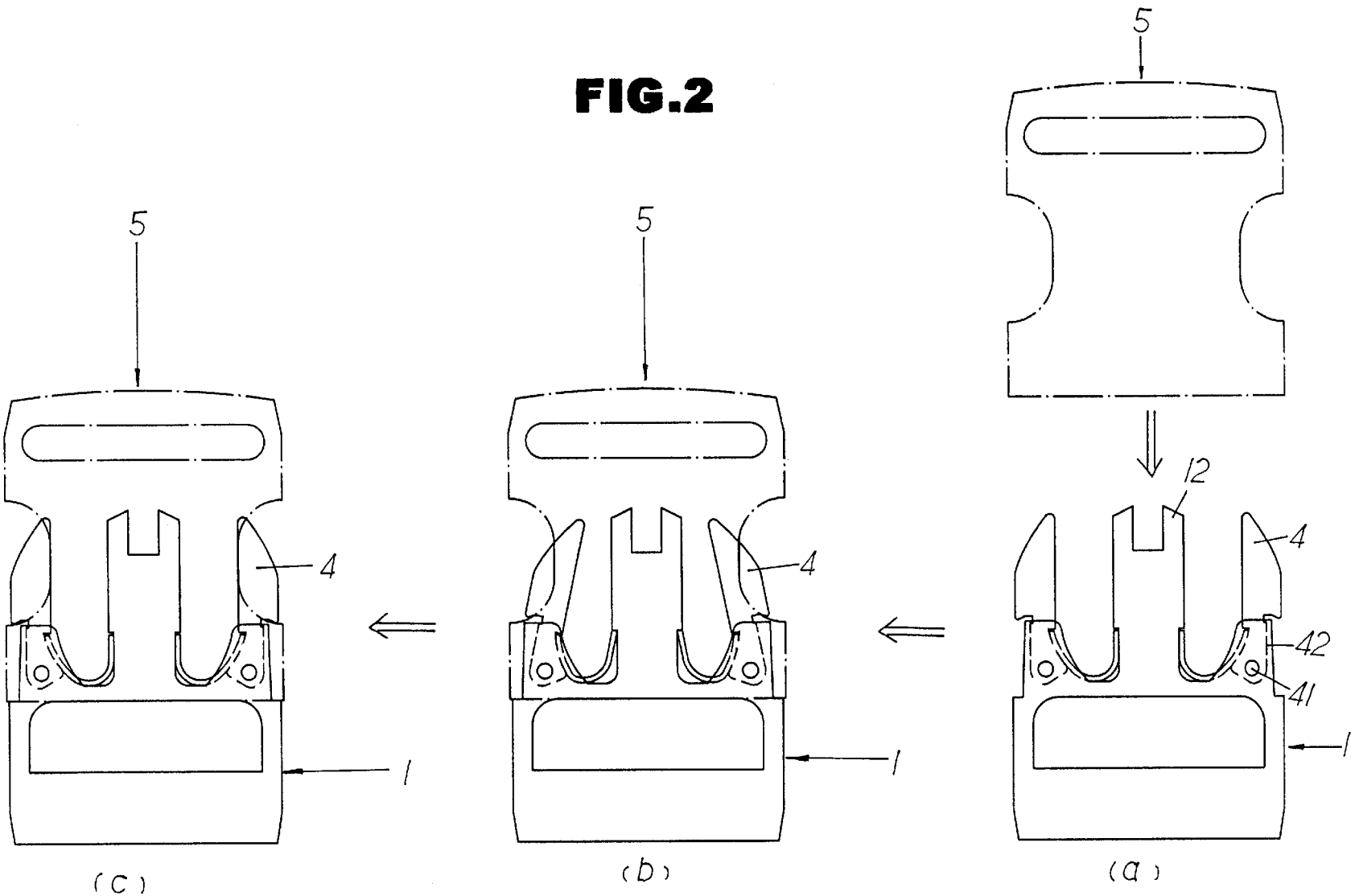
FIG. 2 shows the actions of a buckle structure according to a preferred embodiment of the present invention when it is in use.

Please refer to FIG. 2, which shows an improved movable buckle structure when it is in use, including the states before, during, and after the male connector 1 and the female connector 5 are buckled (as shown in (a), (b), and (c)). The external side of the two U-shape grooves and the external side of the two bases form two deformation proof walls 42 to prevent the two latching blocks 4 from being over extended or damaging the movable buckle structure so that it will be unable to lock or unlock the buckle as shown in (a).

Figure 3:
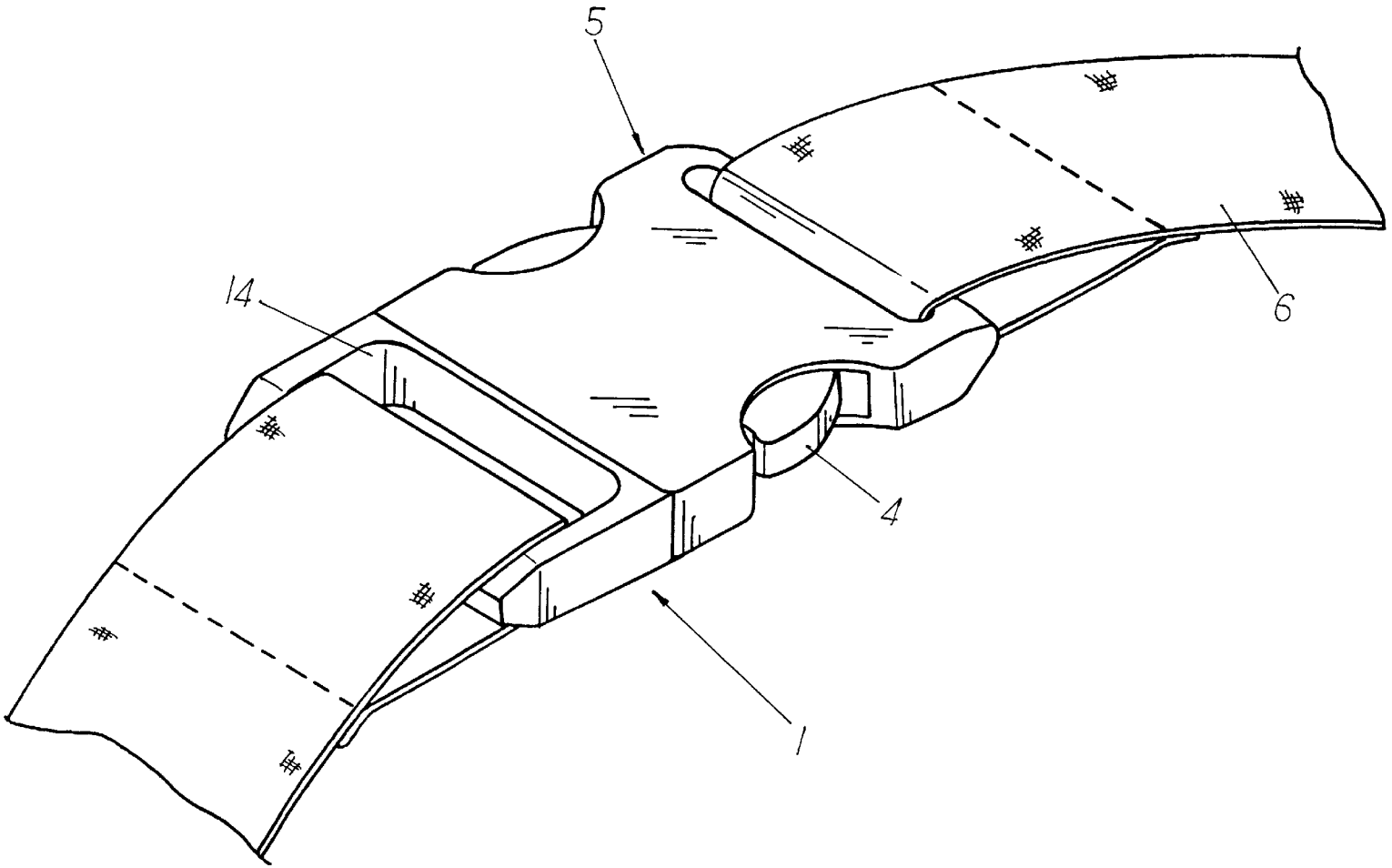
FIG. 3 shows the diagram of the buckle structure of the present invention when the belt is installed

Finally, refer to FIG. 3, which shows an embodiment of the present invention when the belt 6 is installed onto the movable buckle structure.

Therefore, in summation of the above description, the improved buckle of the present invention obviously makes improvement to the traditional buckle. The inventor of the present invention based on years of experience in the related industry conducted extensive research to enhance the structure herein which is hereby submitted for patent application.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved movable buckle structure, comprising:

a metal female connector having a belt hole for receiving a belt;

a metal male connector having:

two integrally formed bases, a protruding guiding block defining a front end of the male connector, and being disposed between the bases, two concave grooves, each being defined by an inner side of a respective base, and a respective outer side at a bottom of the guiding block;

two elastic brackets, each being accommodated and fixed within a respective one of the grooves, and two latching blocks, each being pivotally attached to a respective base, and each cooperating with a respective elastic bracket in order to attain the effect of locking and detaching of the male and female connectors, wherein an inner side of each latching block and the respective outer side at the bottom of said guiding block each has a pressing surface that fixes the respective elastic bracket in position.

2. An improved movable buckle structure as claimed in claim 1, wherein each elastic bracket has a U-shape.

3. An improved movable buckle structure as claimed in claim 1, wherein each said latching block has a pivotal hole for receiving a pivotal member to couple the respective latching block to the respective base.

* * * * *